US011866806B2

(12) United States Patent
Ma et al.

(10) Patent No.: US 11,866,806 B2
(45) Date of Patent: Jan. 9, 2024

(54) CORROSION-RESISTANT NICKEL ALLOY, PREPARATION METHOD THEREFOR AND USE THEREOF

(71) Applicant: TIANJIN UNIVERSITY, Tianjin (CN)

(72) Inventors: Wenchao Ma, Tianjin (CN); Sixuan Zeng, Tianjin (CN); Terrence Wenga, Tianjin (CN)

(73) Assignee: TIANJIN UNIVERSITY, Tianjin (CN)

( * ) Notice: Subject to any disclaimer, the term of this patent is extended or adjusted under 35 U.S.C. 154(b) by 0 days.

(21) Appl. No.: 18/077,253

(22) Filed: Dec. 8, 2022

(65) Prior Publication Data

US 2023/0212715 A1 Jul. 6, 2023

(30) Foreign Application Priority Data

Dec. 31, 2021 (CN) ..... 202111678210.2

(51) Int. Cl.
*C22C 19/05* (2006.01)
*C22C 1/02* (2006.01)

(52) U.S. Cl.
CPC ..... *C22C 19/055* (2013.01); *C22C 1/023* (2013.01)

(58) Field of Classification Search
CPC ..... C22C 19/055
See application file for complete search history.

(56) References Cited

U.S. PATENT DOCUMENTS 4,569,824 A * 2/1986 Duhl ..... C22C 19/055 420/446
2020/0017949 A1* 1/2020 Hayashi ..... C23C 4/08

FOREIGN PATENT DOCUMENTS

| | | | |
|---|---|---|---|
| CN | 105671471 | A | 6/2016 |
| CN | 113718208 | A | 11/2021 |
| CN | 13737058 | A | 12/2021 |
| EP | 1798300 | A1 | 6/2007 |

* cited by examiner

*Primary Examiner* — Christopher S Kessler
(74) *Attorney, Agent, or Firm* — Bayramoglu Law Offices LLC

(57) ABSTRACT

A corrosion-resistant nickel alloy, a preparation method thereof and, and a use thereof are provided. The alloy includes the following components in percentage by mass: 4.68-5.35% of B, 5.69-6.41% of W, 27.68-28.39% of Cr, 12.65-13.42% of Al, and the balance of Ni and inevitable impurities. The alloy disclosed by the present invention is a Ni—W—B ternary alloy with main components of Ni, W and B, wherein the three elements have strong high-temperature corrosion resistance at a temperature of about 600° C., and have the potential of solid solution hardening and precipitate formation because all belong to solid solution forming elements, so that a creep strength of a nickel alloy matrix is improved. Meanwhile, Al and Cr are further added in the alloy formula, so that $Al_2O_3$ and $Cr_2O_3$ oxide layers can be formed, which play a role as a physical diffusion barrier against chlorine gas and other corrosive gases.

5 Claims, 1 Drawing Sheet

| Element | Atomic % |
|---|---|
| O K | 9.58 |
| S K | 7.58 |
| Na K | 77.56 |
| Cr L | 0.92 |
| W M | 1.10 |

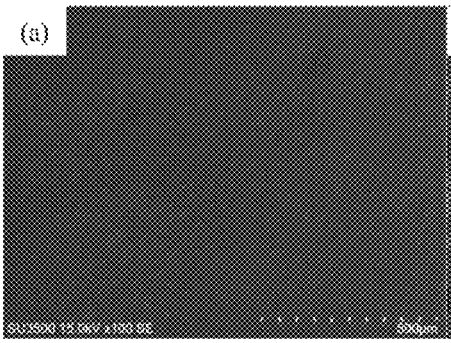
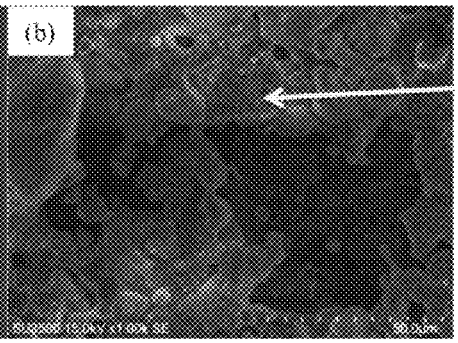
| Element | Atomic % |
|---|---|
| O K | 9.58 |
| S K | 7.58 |
| Na K | 77.56 |
| Cr L | 0.92 |
| W M | 1.10 |
FIG. 1A
FIG. 1B
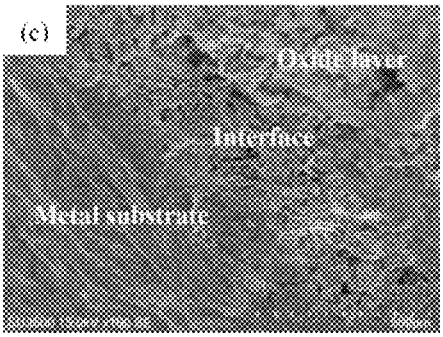
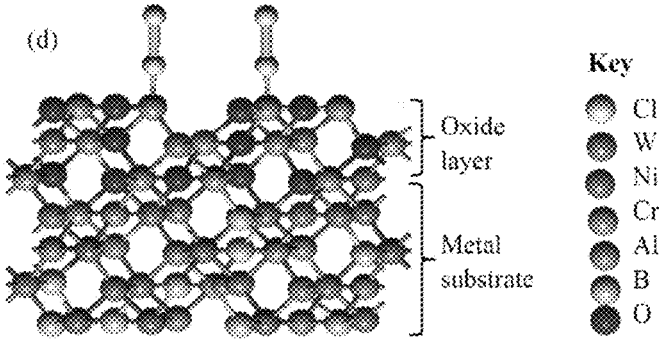
FIG. 1C
FIG. 1D

CORROSION-RESISTANT NICKEL ALLOY, PREPARATION METHOD THEREFOR AND USE THEREOF

CROSS REFERENCE TO THE RELATED APPLICATIONS

This application is based upon and claims priority to Chinese Patent Application No. 202111678210.2, filed on Dec. 31, 2021, the entire contents of which are incorporated herein by reference.

TECHNICAL FIELD

The present invention relates to the technical field of corrosion-resistant alloys, and in particular to a corrosion-resistant nickel alloy, a preparation method therefor and use thereof.

BACKGROUND

In recent years, the urban domestic waste incineration technology has developed rapidly, and has become an emerging green environmental protection treatment means. However, since the domestic waste is rich in chlorine, sulfur, alkali metals, heavy metals, and other substances, the domestic waste is evaporated to a superheater along with flue gas after being incinerated, thus forming ash and leading to high-temperature corrosion of the superheater and other heat exchangers, which causes that waste incineration power plants are forced to operate under lower steam parameters (about 400° C., 4 Mpa), and the boiler efficiency is only about 20%. Moreover, the high-temperature corrosion can cause potential safety hazards such as boiler tube explosion, and increase the operation cost. Therefore, solving the problem of high-temperature corrosion in a waste incinerator is very important for developing the waste energy utilization industry.

Currently, the alloys commonly used in waste incineration power plants are Esshete 1250, Inconel 625, 304, 13CrMo4-5TS, and the like, and although iron-based alloys (such as 304 alloy and 13CrMo4-5TS) are cheap and readily available, they are not corrosion-resistant, while although nickel-based alloys (such as Esshete 1250 and Inconel 625) are not easy to corrode, they are expensive. Therefore, there is an urgent need to develop a cost-effective corrosion-resistant alloy.

SUMMARY

The present invention is intended to provide a corrosion-resistant nickel alloy, a preparation method therefor and use thereof, and solves the problems of high alloy cost and poor corrosion resistance in the existing waste incineration power plants.

In order to achieve the above objective, the present invention provides the following technical schemes.

The present invention provides a corrosion-resistant nickel alloy, which comprises the following components in percentage by mass:

4.68-5.35% of B, 5.69-6.41% of W, 27.68-28.39% of Cr, 12.65-13.42% of Al, and the balance of Ni and inevitable impurities.

Preferably, the corrosion-resistant nickel alloy comprises the following components in percentage by mass:

4.72-5.17% of B, 5.86-6.33% of W, 27.97-28.21% of Cr, 12.75-13.22% of Al, and the balance of Ni and inevitable impurities.

Preferably, the corrosion-resistant nickel alloy comprises the following components in percentage by mass:

5% of B, 6% of W, 28% of Cr, 13% of Al, and the balance of Ni and inevitable impurities.

The present invention further provides a method for preparing the corrosion-resistant nickel alloy, which comprises the following steps:

smelting raw materials in a protective atmosphere, then performing refining under thermal insulation, performing cooling to a temperature of 60-70° C. after the refining is completed, and repeating the smelting and refining for 2-3 times to obtain the corrosion-resistant nickel alloy.

Preferably, in the method for preparing the corrosion-resistant nickel alloy, a device for the smelting is a vacuum suspension smelting furnace, and the smelting is smelting with a power increased in a stepwise manner and comprises the following specific steps:

performing heating to a temperature of 1700-1760° C. from room temperature within 20-30 min, adjusting a heating power to 100 kW, and performing the smelting for 4-7 min; then increasing the heating power to 120 kW, and performing the smelting for 5-7 min; and then, increasing the heating power to 140 kW, and performing the smelting for 5-6 min.

Preferably, in the method for preparing the corrosion-resistant nickel alloy, the heating power for the refining is 120 kW, and the refining is performed for 5-10 min.

Preferably, in the method for preparing the corrosion-resistant nickel alloy, the step of cooling is performed by reducing the temperature to 900° C. at 76-82° C./min, and then reducing the temperature to 60-70° C. at 40-45° C./min.

The present invention further provides use of the corrosion-resistant nickel alloy in a superheater of a waste incinerator.

It can be known from the technical schemes that as compared with the prior art, the present invention has the following beneficial effects:

The alloy disclosed by the present invention is a Ni—W—B ternary alloy with main components of Ni, W and B, wherein the three elements have strong high-temperature corrosion resistance at a temperature of about 600° C., and have the potential of solid solution hardening and precipitate formation because all belong to solid solution forming elements, so that a creep strength of a nickel alloy matrix is improved. Meanwhile, Al and Cr are further added in the alloy formula, so that $Al_2O_3$ and $Cr_2O_3$ oxide layers can be formed, which play a role as a physical diffusion barrier against chlorine gas and other corrosive gases.

BRIEF DESCRIPTION OF THE DRAWINGS

In order to more clearly illustrate the technical schemes in the examples of the present invention or in the prior art, the drawings used in the description of the examples or the prior art are briefly introduced below.

FIGS. 1A-1D are diagrams of SEM representations and geometrical structures of gaseous Cl molecules for an alloy before and after a corrosion simulation experiment of the alloy according to Example 1;

wherein FIG. 1A is a surface SEM image before the corrosion simulation experiment; FIG. 1B is a surface SEM image after the corrosion simulation experiment; FIG. 1C is a cross-section SEM image after the corrosion simulation experiment; and FIG. 1D is a diagram of the geometrical structure of gaseous Cl molecules for the alloy.

DETAILED DESCRIPTION OF THE EMBODIMENTS

The present invention provides a corrosion-resistant nickel alloy, which comprises the following components in percentage by mass:

4.68-5.35% of B, 5.69-6.41% of W, 27.68-28.39% of Cr, 12.65-13.42% of Al, and the balance of Ni and inevitable impurities.

Preferably, the present invention comprises the following components in percentage by mass:

4.72-5.17% of B, 5.86-6.33% of W, 27.97-28.21% of Cr, 12.75-13.22% of Al, and the balance of Ni and inevitable impurities.

Further preferably, the present invention comprises the following components in percentage by mass:

4.79-5.11% of B, 5.89-6.26% of W, 27.98-28.03% of Cr, 12.82-13.14% of Al, and the balance of Ni and inevitable impurities.

More preferably, the present invention comprises the following components in percentage by mass:

5% of B, 6% of W, 28% of Cr, 13% of Al, and the balance of Ni and inevitable impurities.

In the present invention, if the Al has a low content, a composite oxide consisting of $Al_2O_3$, $NiCr_2O_4$ and $Cr_2O_3$ is formed inside the alloy, resulting in high reaction rate and poor oxidation resistance; if the Cr has a low content, the alloy has poor oxidation resistance, and if the Cr has a high content, the proportion of the alloy distributed to the Ni—W—B three-phase system is small, and the requirement of the overall performance of the alloy cannot be met.

The present invention further provides a method for preparing the corrosion-resistant nickel alloy, which comprises the following steps:

adding raw materials into a vacuum suspension smelting furnace, performing vacuumization to $10^{-2}$-$8\times10^{-2}$ Pa, introducing high-purity argon gas, performing electrifying and heating for smelting, then performing refining under thermal insulation, performing cooling to a temperature of 60-70° C. after the refining is completed, and repeating the smelting and refining for 2-3 times to obtain the corrosion-resistant nickel alloy.

In the present invention, the smelting is smelting with a power increased in a stepwise manner and comprises the following specific steps:

performing heating to a temperature of 1700-1760° C. from room temperature within 20-30 min, adjusting a heating power to 100 kW, and performing the smelting for 4-7 min; then increasing the heating power to 120 kW, and performing the smelting for 5-7 min; and then, increasing the heating power to 140 kW, and performing the smelting for 5-6 min.

Further preferably, performing heating to a temperature of 1706-1754° C. from room temperature within 21-27 min, adjusting a heating power to 100 kW, and performing the smelting for 4.2-6.4 min; then increasing the heating power to 120 kW, and performing the smelting for 5.1-6.5 min; and then, increasing the heating power to 140 kW, and performing the smelting for 5.1-5.8 min.

More preferably, performing heating to a temperature of 1736° C. from room temperature within 24 min, adjusting a heating power to 100 kW, and performing the smelting for 5.3 min; then increasing the heating power to 120 kW, and performing the smelting for 5.3 min; and then, increasing the heating power to 140 kW, and performing the smelting for 5.6 min.

In the present invention, the heating power for the refining is 120 kW; and the refining is performed for preferably 5-10 min, further preferably 6-9 min, and more preferably 8 min.

In the present invention, the step of cooling is performed by preferably reducing the temperature to 900° C. at 76-82° C./min, and then reducing the temperature to 60-70° C. at 40-45° C./min; further preferably reducing the temperature to 900° C. at 78-81° C./min, and then reducing the temperature to 62-69° C. at 41-44° C./min; and more preferably reducing the temperature to 900° C. at 79° C./min, and then reducing the temperature to 66° C. at 43° C./min.

The present invention further provides use of the corrosion-resistant nickel alloy in a superheater of a waste incinerator.

The technical solutions in the embodiments of the present invention will be clearly and completely described below. Apparently, the described embodiments are merely a part, rather than all of the embodiments of the present invention. Based on the embodiments of the present invention, all other embodiments obtained by those of ordinary skilled in the art without creative efforts shall fall within the protection scope of the present invention.

Example 1

The present invention provides a corrosion-resistant nickel alloy, which comprises the following components in percentage by mass: 5% of B, 6% of W, 28% of Cr, 13% of Al, and the balance of Ni and inevitable impurities.

The method for preparing the corrosion-resistant nickel alloy comprises the following steps:

mixing boron powder, tungsten powder, chromium sheets, aluminum sheets and nickel powder with a purity of 99.9%, then adding the mixture into a vacuum suspension smelting furnace; firstly performing vacuumization to $10^{-2}$ Pa, then introducing high-purity argon gas, performing heating to a temperature of 1710° C. from room temperature within 22 min, adjusting a heating power to 100 kW, and performing smelting for 5 min; increasing the heating power to 120 kW, and performing the smelting for 6 min; then increasing the heating power to 140 kW, and performing the smelting for 5 min; and adjusting the heating power to 120 kW and performing the refining for 6 min under thermal insulation, reducing the temperature to 900° C. at 77° C./min after the refining is completed and then reducing the temperature to 65° C. at 42° C./min, and repeating the smelting and refining for 2 times to obtain the corrosion-resistant nickel alloy.

Example 2

The present invention provides a corrosion-resistant nickel alloy, which comprises the following components in percentage by mass: 4.77% of B, 5.79% of W, 27.93% of Cr, 12.84% of Al, and the balance of Ni and inevitable impurities.

The method for preparing the corrosion-resistant nickel alloy comprises the following steps:

mixing boron powder, tungsten powder, chromium sheets, aluminum sheets and nickel powder with a purity of 99.9%, then adding the mixture into a vacuum suspension smelting furnace; firstly performing vacuumization to $2\times10^{-7}$ Pa, then introducing high-purity argon gas, performing heating to a temperature of 1756° C. from room temperature within 25 min, adjusting a heating power to 100 kW, and performing smelting for 4 min; increasing the heating power to 120 kW, and performing the smelting for 7 min; then increasing the heating power to 140 kW, and performing the smelting for 6 min; and adjusting the heating power to 120 kW and performing the refining for 7 min under thermal insulation, reducing the temperature to 900° C. at 79° C./min after the refining is completed and then reducing the temperature to 60° C. at 40° C./min, and repeating the smelting and refining for 2 times to obtain the corrosion-resistant nickel alloy.

Example 3

The present invention provides a corrosion-resistant nickel alloy, which comprises the following components in percentage by mass: 5.16% of B, 6.13% of W, 27.79% of Cr, 12.92% of Al, and the balance of Ni and inevitable impurities.

The method for preparing the corrosion-resistant nickel alloy comprises the following steps:

mixing boron powder, tungsten powder, chromium sheets, aluminum sheets and nickel powder with a purity of 99.9%, then adding the mixture into a vacuum suspension smelting furnace; firstly performing vacuumization to $6\times10^{-2}$ Pa, then introducing high-purity argon gas, performing heating to a temperature of 1752° C. from room temperature within 28 min, adjusting a heating power to 100 kW, and performing smelting for 6 min; increasing the heating power to 120 kW, and performing the smelting for 5 min; then increasing the heating power to 140 kW, and performing the smelting for 5 min; and adjusting the heating power to 120 kW and performing the refining for 9 min under thermal insulation, reducing the temperature to 900° C. at 80° C./min after the refining is completed and then reducing the temperature to 66° C. at 43° C./min, and repeating the smelting and refining for 3 times to obtain the corrosion-resistant nickel alloy.

Example 4

The present invention provides a corrosion-resistant nickel alloy, which comprises the following components in percentage by mass: 5.35% of B, 5.69-6.41% of W, 28.11% of Cr, 13.2% of Al, and the balance of Ni and inevitable impurities.

The method for preparing the corrosion-resistant nickel alloy comprises the following steps:

mixing boron powder, tungsten powder, chromium sheets, aluminum sheets and nickel powder with a purity of 99.9%, then adding the mixture into a vacuum suspension smelting furnace; firstly performing vacuumization to $8\times10^{-2}$ Pa, then introducing high-purity argon gas, performing heating to a temperature of 1760° C. from room temperature within 30 min, adjusting a heating power to 100 kW, and performing smelting for 7 min; increasing the heating power to 120 kW, and performing the smelting for 5 min; then increasing the heating power to 140 kW, and performing the smelting for 5 min; and adjusting the heating power to 120 kW and performing the refining for 10 min under thermal insulation, reducing the temperature to 900° C. at 82° C./min after the refining is completed and then reducing the temperature to 70° C. at 45° C./min, and repeating the smelting and refining for 3 times to obtain the corrosion-resistant nickel alloy.

Corrosion resistance performance: the corrosion simulation experiment was performed on the alloy in Example 1 at 600° C. in a corrosive environment (1550 ppm HCl, 250 ppm $SO_2$, 20 vol % $H_2O$, 8 vol % $O_2$, and a carrier gas of $N_2$) for 300 h, and compared with Esshete 1250, Inconel 625, 304, and 13CrMo4-5TS (all purchased from Tianjin Iron and Steel Group Co., Ltd.), the corrosion rate results are shown in Table 1.

The SEM morphologies of the alloy in Example 1 before and after the corrosion simulation experiment were measured, the geometrical structure of gaseous Cl molecules for the alloy was simulated, and the results are shown in FIGS. 1A-1D. It can be seen from FIG. 1A that the alloy had a smooth surface before corrosion, and several scratches therein were caused by grinding a sample with SiC sand paper at the sample preparation stage. As shown in FIG. 1B, after 300 hours of corrosion, corrosion products appeared on the alloy surface; two distinct features can be observed on the surface: (1) a smooth circular feature, which was NaCl salt; and (2) a rough, irregularly shaped diffusion feature, with compositions of 9.58 atomic. % O, 7.58 atomic. % S, 77.56 atomic. % sodium, 0.92 atomic. % Cr, and 1.10 atomic. % W shown by energy dispersive analysis (EDS), and the compositions indicated the presence of $Na_2SO_4$, $Na_2CrO_4$, WO, and $Cr_2O_3$. When the alloys (stainless steels) were heated to 425° C. or above, they precipitated chromium compounds at grain boundaries; and the depletion of chromium at the grain boundaries caused the selective diffusion of Cr from intragranular centers to the grain boundaries for replenishment. Cr and W were oxidized to form a protective oxide layer that prevented further inward diffusion of chloride ions into the metal substrate, thereby preventing further corrosion. It can be seen from the cross-section shown in FIG. 1C, the interface had certain pores and gaps, indicating that the metal was corroded, which indicated that the alloy in the present invention was also subjected to a certain corrosion process although it had a stronger corrosion resistance compared with the conventional alloy. As shown in FIG. 1D, the corrosion resistance mechanism of the alloy was simulated using the first-nature principle and the density-functional theory (DFT). The DFT had been successfully applied to corrosion process calculation that simulated the protective properties of the oxide layer. After the oxide layer was formed, the energy required for the bond between Cr and the oxide layer to break was larger, which indicated that Cl cannot react with the oxide layer.

Cost: the alloy in Example 1, Esshete 1250, Inconel 625, 304, and 13CrMo4-5TS were subjected to cost calculation, and the results are shown in Table 1.

In the cost calculation, all of the metal elements (Ni, Al, Fe, Nb, Si, Mn, Mo, V, and B) were considered in this study, bulk commodity prices for metals are sourced from the London Metal Exchange (LME), and in addition, annual material price data is derived from historical statistics from the United States Geological Survey (USGS). Considering the impact of changes in metal prices on economic analysis, averages of price data from 2000 to 2015 were calculated. Other related costs, such as insurance, local taxes, maintenance, miscellaneous materials, and labor costs, are counted as constants and are not included in this evaluation.

TABLE 1

Test results for performance of corrosion-resistant nickel alloy

| Item | Corrosion rate (g/300 h) | Cost (dollar/ton) |
|---|---|---|
| Example 1 | 0.0189 | 6895.91 |
| Esshete 1250 | 0.01 | 8452.13 |
| Inconel 625 | 0.0187 | 10803.4 |
| 304 | 0.029 | 3195.78 |
| 13CrMo4-5TS | 0.067 | 649.73 |

It can be seen from Table 1 that the corrosion rate of the nickel alloy in the present invention can be as low as 0.0189 g/300 h, and the nickel alloy has better corrosion resistance compared with the conventional 304 and 13CrMo4-5TS materials; although the corrosion rate of the nickel alloy is similar to that of Inconel 625, the cost of the nickel alloy is about 36% lower than that of Inconel 625, and the cost of the nickel alloy is reduced by about 22.6% compared with that of Esshete 1250. Although the iron-based alloys 304 and 13CrMo4-5TS have low cost, they have poor corrosion resistance, and need to be replaced in a short time, which causes higher replacement cost. Therefore, the corrosion resistance and the cost should be comprehensively considered in practical application, and the alloy material in the present invention has better corrosion resistance, and meanwhile reduces the cost, so that the large-scale application of the alloy in the field of superheaters is facilitated.

The above descriptions are only preferred embodiments of the present invention. It should be noted that those of ordinary skill in the art can also make several improvements and modifications without departing from the principle of the present invention, and such improvements and modifications shall fall within the protection scope of the present invention.

What is claimed is:

1. A method for preparing a corrosion-resistant nickel alloy, comprising the following steps:

smelting raw materials in a protective atmosphere, then performing a refining under a thermal insulation, performing a cooling to a temperature of 60-70° C. after the refining is completed, and repeating the smelting and the refining for 2-3 times to obtain the corrosion-resistant nickel alloy;

wherein the corrosion-resistant nickel alloy comprises the following components in percentage by mass;

4.16-5.35% of B, 5.69-5.79% of W, 27.68-28.39% of Cr, 12.65-13.42% of Al, and a balance of Ni and inevitable impurities.

2. The method for preparing the corrosion-resistant nickel alloy according to claim 1, wherein a device for the smelting is a vacuum suspension smelting furnace, and the smelting is smelting with a power increased in a stepwise manner and comprises the following specific steps:

performing a heating to a temperature of 1700-1760° C. from room temperature within 20-30 min, adjusting a heating power to 100 kW, and performing the smelting for 4-7 min; then increasing the heating power to 120 kW, and performing the smelting for 5-7 min; and then, increasing the heating power to 140 kW, and performing the smelting for 5-6 min.

3. The method for preparing the corrosion-resistant nickel alloy according to claim 1, wherein a heating power for the refining is 120 kW, and the refining is performed for 5-10 min.

4. The method for preparing the corrosion-resistant nickel alloy according to claim 3, wherein the cooling is performed by reducing the temperature to 900° C. at 76-82° C./min, and then reducing the temperature to 60-70° C. at 40-45° C./min.

5. The method for preparing the corrosion-resistant nickel alloy according to claim 2, wherein a heating power for the refining is 120 kW, and the refining is performed for 5-10 min.

* * * * *